US007802409B2

(12) United States Patent
Stott

(10) Patent No.: US 7,802,409 B2
(45) Date of Patent: Sep. 28, 2010

(54) SYSTEM OF CONCRETE STRUCTURES HAVING PANEL AND COLUMN PORTIONS WITH RIGID MEMBER AND END OF PANEL PORTION OF ONE STRUCTURE RECEIVED IN SLOT OF COLUMN PORTION OF ADJACENT STRUCTURE

(75) Inventor: Gale J. Stott, Salt Lake City, UT (US)

(73) Assignee: Intellectual Property Management, LLC, Salt Lake City, UT (US)

( * ) Notice: Subject to any disclaimer, the term of this patent is extended or adjusted under 35 U.S.C. 154(b) by 655 days.

(21) Appl. No.: 11/231,440

(22) Filed: Sep. 20, 2005

(65) Prior Publication Data

US 2007/0062142 A1 Mar. 22, 2007

(51) Int. Cl.
*E02D 27/32* (2006.01)
*E04B 2/00* (2006.01)

(52) U.S. Cl. ..... 52/295; 52/592.4; 52/436; 52/442

(58) Field of Classification Search ..... 52/169.9, 52/169.3, 169.4, 297, 592.1, 592.3, 477; 256/19
See application file for complete search history.

(56) References Cited

U.S. PATENT DOCUMENTS 1,045,519 A * 11/1912 Conzelman ..... 256/19
1,247,107 A * 11/1917 Graham ..... 256/19
1,276,264 A 8/1918 Porter et al.
1,712,678 A 5/1929 Redman
1,754,087 A 4/1930 Flam
1,937,306 A 11/1933 Barriball
2,185,335 A 1/1940 Fischer
2,474,654 A 6/1949 Carlson
2,651,391 A 9/1953 Havens
2,745,638 A * 5/1956 O'Connor ..... 256/19
2,981,997 A 5/1961 Painter
3,260,494 A 7/1966 Deiggaard
3,360,231 A 12/1967 Adrianus
3,381,929 A 5/1968 Bancker
3,481,093 A 12/1969 Davidson
3,507,084 A 4/1970 Jay et al.
3,530,676 A * 9/1970 York ..... 405/285
3,554,495 A * 1/1971 Bach et al. ..... 256/19
3,600,864 A * 8/1971 Godley et al. ..... 52/235
3,635,642 A 1/1972 Mueller
3,731,902 A 5/1973 Shoemaker (Continued)

FOREIGN PATENT DOCUMENTS

GB 2241192 8/1991

(Continued)

*Primary Examiner*—Gay Ann Spahn
(74) *Attorney, Agent, or Firm*—Workman Nydegger

(57) ABSTRACT

A concrete structure system formed of pre-cast concrete may form a wall having a decorative surface treatment. The structure system may include a column portion and a panel portion. The column portion may include a slot for receiving a panel portion of an adjacent structure. The column portion may also include an opening for receiving a substantially rigid member for supporting the column portion in an upright position. The substantially rigid member may be embedded in or attached to a footing for supporting the structure. Various different techniques for attaching the substantially rigid member and/or column portion to the footing are disclosed can be used.

24 Claims, 7 Drawing Sheets

U.S. PATENT DOCUMENTS 3,743,232 A 7/1973 Vaughan
3,843,089 A 10/1974 Scholz et al.
3,938,294 A * 2/1976 Gaburri ..... 52/742.14
3,948,009 A * 4/1976 Bernhard ..... 52/144
3,954,377 A 5/1976 Scholz et al.
4,037,816 A 7/1977 Scott
4,156,516 A 5/1979 Oliver
4,178,343 A 12/1979 Rojo, Jr.
4,181,286 A 1/1980 Van Doren
4,193,584 A * 3/1980 Wieser ..... 256/19
4,241,554 A 12/1980 Infantino
4,286,934 A 9/1981 Linetsky
4,290,246 A 9/1981 Hilsey
4,516,372 A 5/1985 Grutsch
4,579,312 A 4/1986 White
4,614,325 A 9/1986 Muldery et al.
4,669,240 A 6/1987 Amormino
4,694,624 A 9/1987 Juhas
4,769,191 A 9/1988 Diana
4,862,660 A 9/1989 Raymond
4,887,691 A * 12/1989 Rotondo ..... 181/210
5,028,368 A 7/1991 Grau
5,065,561 A 11/1991 Mason
5,098,059 A 3/1992 Sawyer
5,154,837 A 10/1992 Jones
5,184,808 A * 2/1993 Vesper ..... 256/31
5,202,132 A 4/1993 Myers et al.
5,274,971 A * 1/1994 Elmore et al. ..... 52/144
5,344,700 A * 9/1994 McGath et al. ..... 428/304.4
5,368,416 A * 11/1994 Cataldo ..... 405/285
5,404,685 A 4/1995 Collins
5,459,970 A 10/1995 Kim
5,471,811 A * 12/1995 House et al. ..... 52/745.1
5,486,391 A 1/1996 Tyner
5,501,057 A * 3/1996 Dawson ..... 52/761
5,509,249 A 4/1996 House et al.
5,524,405 A * 6/1996 Byrd ..... 52/295
5,566,517 A * 10/1996 Ishii et al. ..... 52/387
5,588,786 A 12/1996 House et al.
5,689,927 A * 11/1997 Knight, Sr. ..... 52/297
5,728,312 A 3/1998 Van Doren
5,833,873 A 11/1998 Adonetti
5,845,448 A 12/1998 Potvin
5,860,262 A 1/1999 Johnson
5,881,524 A 3/1999 Ellison, Jr.
5,887,404 A 3/1999 Kreizinger
5,904,446 A * 5/1999 Carlinsky et al. ..... 405/229
5,922,236 A 7/1999 Zuhl
5,930,970 A 8/1999 De Le fevre
6,000,182 A 12/1999 Keenan
6,003,278 A 12/1999 Weaver et al.
6,021,994 A 2/2000 Shartzer, Jr.
6,079,909 A * 6/2000 Elmore et al. ..... 405/284
6,199,832 B1 3/2001 Morrow
6,264,867 B1 7/2001 Keenan
6,283,439 B1 9/2001 Myers et al.
6,301,851 B1 10/2001 Matsubara
6,385,933 B1 5/2002 Owens
6,443,666 B1 * 9/2002 Smith ..... 405/286
6,510,667 B1 1/2003 Cottier et al.
6,550,215 B1 4/2003 Pulte et al.
6,550,834 B2 4/2003 Fromelius
6,568,141 B2 5/2003 Kremers
6,571,521 B1 * 6/2003 Ameigh ..... 52/295
6,594,963 B1 7/2003 Bennett
6,622,452 B2 9/2003 Alvaro
6,631,599 B1 10/2003 Takagi
6,712,598 B2 3/2004 Jensen
6,811,357 B1 11/2004 Haug
6,848,232 B2 2/2005 Pulte et al.
6,898,912 B2 5/2005 Bravinski
6,939,121 B2 9/2005 Giri et al.
7,073,767 B1 7/2006 Bennett
7,146,775 B2 12/2006 Burkett
7,165,916 B2 1/2007 Nanayakkara
7,254,925 B2 8/2007 Stefanutti et al.
2002/0000506 A1 1/2002 Khoo
2002/0166302 A1 * 11/2002 Ogorchock ..... 52/294
2003/0163963 A1 9/2003 Pulte et al.
2003/0182889 A1 10/2003 Takagi
2003/0192272 A1 10/2003 Bravinski
2004/0104333 A1 6/2004 Ward et al.
2004/0154246 A1 8/2004 DeSutter
2004/0217254 A1 11/2004 Myers et al.
2005/0029429 A1 2/2005 Schworer
2005/0284059 A1 * 12/2005 Rerup ..... 52/306
2006/0174569 A1 8/2006 Stott
2007/0062142 A1 3/2007 Stott

FOREIGN PATENT DOCUMENTS

WO WO 0062987 10/2000

* cited by examiner

SYSTEM OF CONCRETE STRUCTURES HAVING PANEL AND COLUMN PORTIONS WITH RIGID MEMBER AND END OF PANEL PORTION OF ONE STRUCTURE RECEIVED IN SLOT OF COLUMN PORTION OF ADJACENT STRUCTURE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. The Field of the Invention

The present disclosure relates generally to structural columns and/or walls, and more particularly, but not necessarily entirely, to pre-cast concrete structures and mechanisms for attaching the structures to footings or other such supports.

2. Description of Related Art

Precast concrete structures have been used in the building construction industry for many years. Precast concrete structures may include steel reinforced panels for use in constructing fences, walls, sound barriers, and the like. Precast concrete structures may also include columns for supporting panels or overhead items. High quality precast concrete structures may be formed efficiently since they may be constructed in a factory with specialized equipment, strict quality standards, and controlled conditions not subject to rain, hot or cold temperatures, or builder errors. Moreover, labor savings may be accomplished since precast structures may be formed more efficiently in a factory than constructing a form on site to manufacture the structures in place. Use of precast concrete structures may also reduce construction delays associated with rain or inclement weather since concrete may not be properly poured on site in inclement weather.

In recent years, the use of precast concrete columns and panels with decorative patterns formed on the exterior surface has increased in popularity. The precast concrete panels may have various different patterns such as stone or brick, for example. Such precast concrete panels may be easier to construct than stone or brick walls. Moreover, the precast concrete panels may be durable and provide advantages in that cracking may be reduced as compared to walls formed with grouted natural stone or brick, and no mortar joints are created with precast concrete panels to allow water to seep into the wall.

Various different types of attaching devices and methods are known in the art for joining concrete structures to footings to support the structures in an upright position. Despite the advantages of known attaching devices and methods, improvements are still being sought to improve the efficiency of construction and the quality of the concrete structures.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the disclosure will be set forth in the description that follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
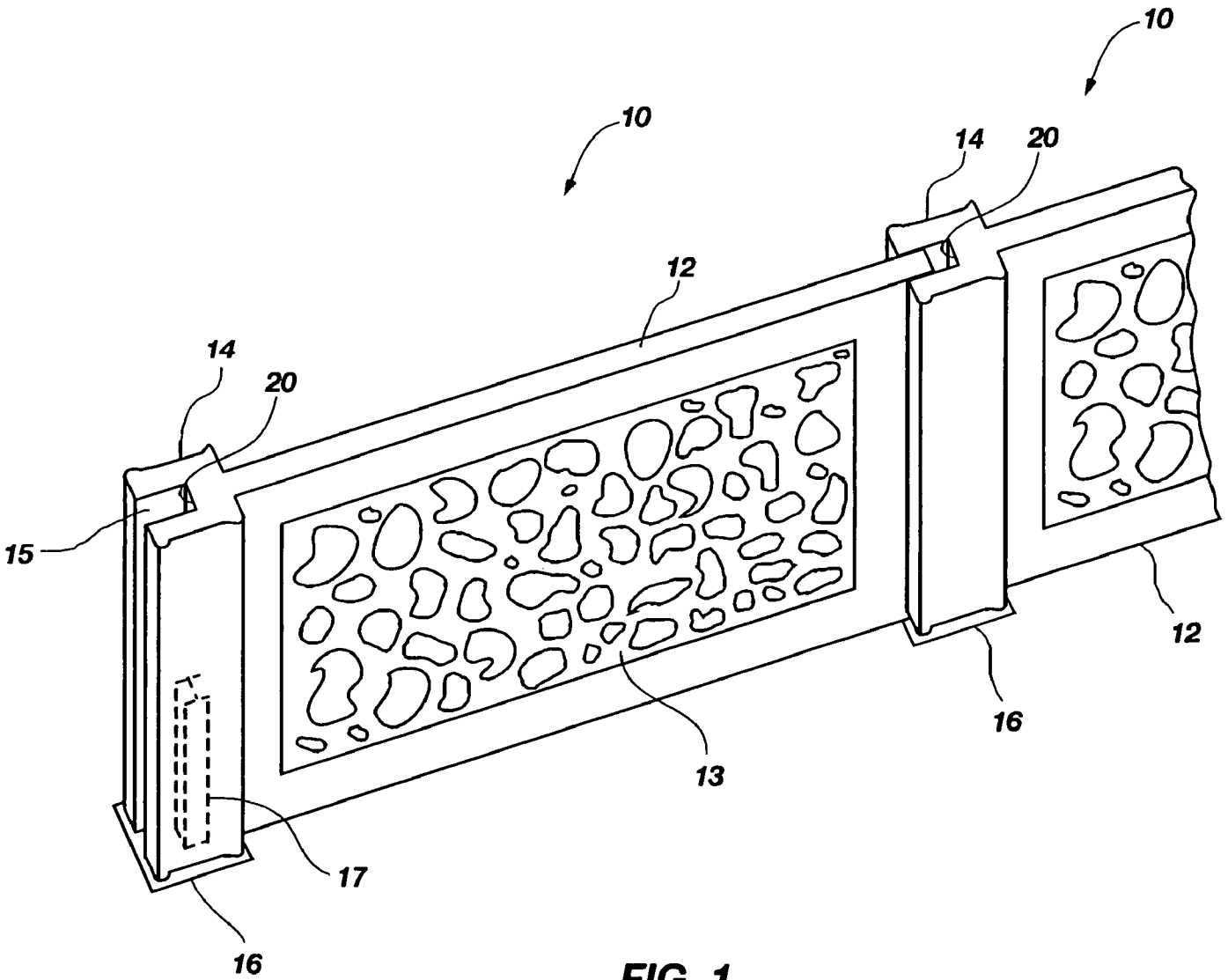
FIG. 1 is a perspective break-away view of one embodiment of structures made in accordance with the principles of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the present concrete structure system is disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present disclosure will be limited only by the appended claims and equivalents thereof.

It must be noted that, as used in this specification and the appended claims, the singular forms "a," "an," and "the" include plural referents unless the context clearly dictates otherwise. Similarly, as used herein, the terms "comprising," "including," "containing," "characterized by," and grammatical equivalents thereof are inclusive or open-ended terms that do not exclude additional, unrecited elements or method steps.

As used herein, the term "concrete" shall be construed broadly to include conglomerate construction materials, including construction materials formed of aggregate and cementitious materials, as well as any other known material that may be placed in a fluid or semi-fluid form and hardened or solidified.

As used herein, the phrase "substantially rigid" shall be construed broadly to include members that may not be completely rigid, but may have sufficient rigidity to support a structure at the time the structure is installed.

As used herein, the phrase "surface treatment" shall be construed broadly to include any variety of textures or designs or features that may be placed on the exterior of a concrete structure.

As used herein, the term "attached" shall be construed broadly to include situations in which members are secured or joined together, including situations in which one member is embedded into another member, and situations in which intervening members are used to join one member to another member such that the two members need not physically contact each other.

Referring now to FIG. 1, a break-away perspective view is shown of a plurality of structures, each structure indicated generally at 10. One embodiment of each structure 10 may be formed of reinforced concrete, and may include a panel portion 12, for forming a wall, such as a fence or sound barrier, for example. The structure 10 may also form part of a retaining wall, building, or any other such construct. The panel portion 12 may include a surface treatment 13 or decorative pattern, such as stone or brick, for example, formed on an exterior surface.

The structure 10 may also include a column portion 14 for supporting the panel portion 12. The column portion 14 may have an increased lateral dimension as compared to the panel portion to allow increased vertical and lateral support of loads as the loads are transferred to a footing, floor, or other support member. The column portion 14 may also include a slot 15 for receiving a panel portion 12 of an adjacent structure 10. Accordingly, a plurality of structures 10 may be joined together to form a wall of a desired length and configuration. It will also be understood that one embodiment of the present disclosure may include a column portion 14 that does not include a panel portion 12.

In one embodiment of the present disclosure, the structure 10 may be supported on footings 16, also sometimes referred to herein as supports. The footings 16 may be formed in any manner known to those skilled in the art, such as cast in place reinforced concrete. A member 17, shown in dashed lines in FIG. 1, such as a substantially rigid member including an "I" beam, post, pipe, rod, or reinforced concrete member, for example, may be attached to the footing 16. As discussed more fully below, it will be understood that some embodiments of the present disclosure may include a rigid member 17 embedded into the footing 16, or other embodiments may include rigid members 17 attached to the footing 16 by welding, bolts, or any other suitable method known to those skilled in the art. The rigid member 17 may be received in an opening 20 joined with the slot 15 of the column portions 14 to support the structure 10 in an upright position. Accordingly, it will be understood that one embodiment of the present disclosure may include an opening 20 that may be contiguous with the slot 15 such that there may be no structural separation between the opening 20 and the slot 15. Some embodiments may also include the placement of concrete within the opening 20 of the column portions 14 to provide additional support to the structure 10 once the concrete hardens. It will be understood that some embodiments of the rigid member 17 may make construction of the structure 10 possible without the need for forming a reinforcing cage on site for receiving cast in place concrete to support the structures 10. Accordingly, the labor requirements for installing the structures may be reduced.

Figure 2:
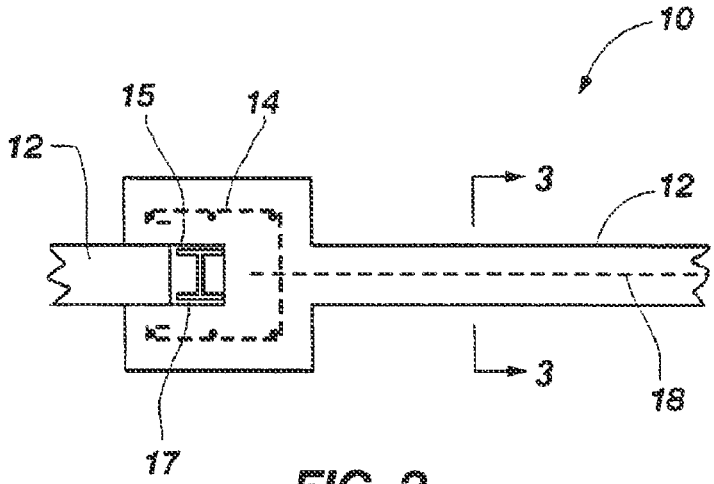
FIG. 2 is a break away top view of an embodiment of structures in accordance with the principles of the present disclosure.

A break-away top view of one embodiment of adjacent structures 10 is shown in FIG. 2. It will be understood that the structures 10 may be formed of pre-cast concrete. The structures 10 may also include reinforcing steel 18, as shown in dashed lines in FIGS. 2 and 3. It will be understood that the configuration of reinforcing steel 18 as well as the concrete formulation may be provided in any suitable manner known to those skilled in the art to provide suitable strength and durability characteristics for the structures 10. It will also be understood that some embodiments of the structure may not include reinforcing steel 18.

The panel portion 12 and the column portion 14 may be formed in any manner known to those skilled in the art, such as by placing concrete in forms in a factory condition so as to produce the structures 10 under controlled conditions. One embodiment of the structure 10 may include the column portion 14 and the panel portion 12 as an integral one piece member of unitary construction without joints. Other embodiments of the present disclosure may be cast in place at a construction site.

Figure 4:
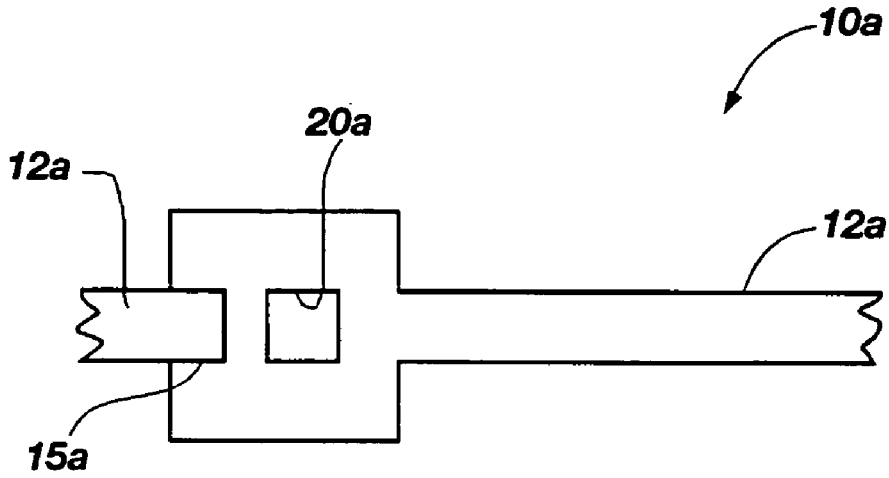
FIG. 4 is a break away top view of an alternative embodiment of structures in accordance with the principles of the present disclosure.

Reference will now to made to FIG. 4 to describe an alternative embodiment of the present disclosure. As previously discussed, the presently disclosed embodiments of the disclosure illustrated herein are merely exemplary of the possible embodiments of the disclosure, including that illustrated in FIG. 4.

Figure 3:
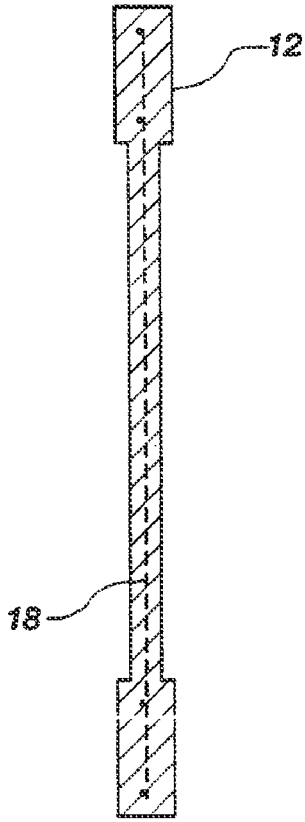
FIG. 3 is a side cross sectional view of a structure of FIG. 2 taken along line A-A.

It will be appreciated that the alternative embodiment of the disclosure illustrated in FIG. 4 may contain many of the same features represented in FIGS. 1-3 and only the new or different features will be explained to most succinctly describe the embodiments of the disclosure illustrated in FIG. 4.

FIG.4 illustrates a break-away top view of an alternative structure 10*a* having an opening 20*a* for receiving a rigid member 17 for supporting the structure 10*a* in an upright position. The opening 20*a* may be separated from the slot 15*a* such that the rigid member 17 may be separated from the panel portion 12*a* of an adjacent structure 10*a*. It will be understood that the size, shape and position of the opening 20*a* may vary in accordance with the principles of the present disclosure.

Figure 5:
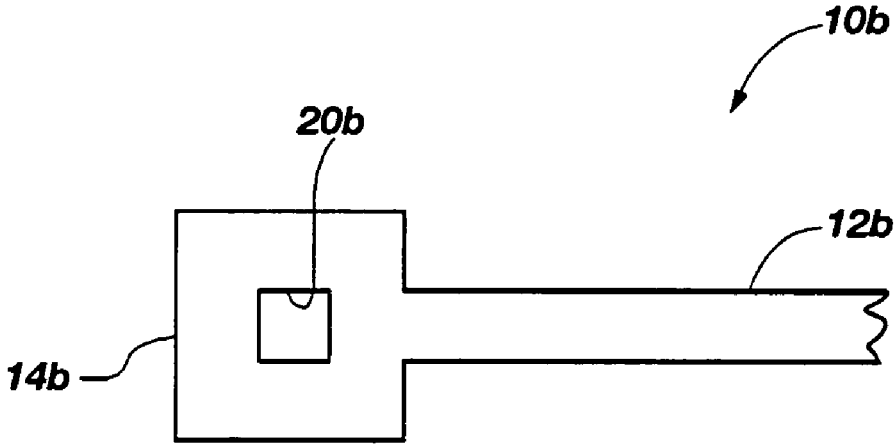
FIG. 5 is a break away top view of an additional alternative embodiment structure in accordance with the principles of the present disclosure.

A break-away top view of an additional alternative embodiment structure 10*b* is shown in FIG. 5. The alternative embodiment structure 10*b* may be formed with a panel portion 12*b* and a column portion 14*b*. The column portion 14*b* may also include an opening 20*b*. However, the alternative embodiment of FIG. 5 may not include a slot. Accordingly, any adjacent structures 10*b*, if present, may be joined without being received within the column portion 14*b*.

Figure 6:
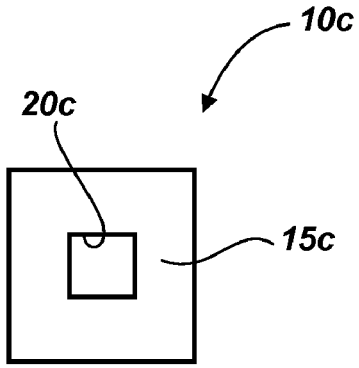
FIG. 6 is a top view of another alternative embodiment structure in accordance with the principles of the present disclosure.

Similarly, as shown in FIG. 6, which shows a top view of yet an additional alternative embodiment structure 10*c*, the column portion 14*c* may be formed without a panel portion or a slot. The structure 10*c* may include an opening 20*c* for receiving a rigid member 17 to support the structure 10*c* in an upright position.

Figure 7:
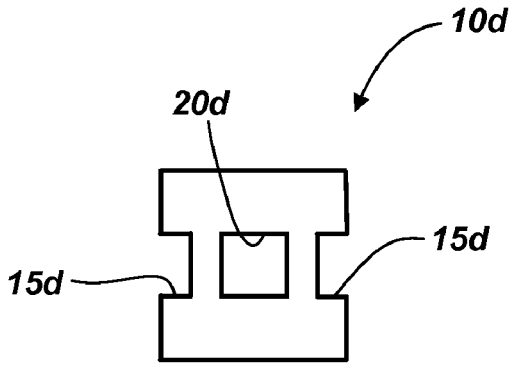
FIG. 7 is a top view of a further alternative embodiment structure in accordance with the principles of the present disclosure.
Figure 7A:
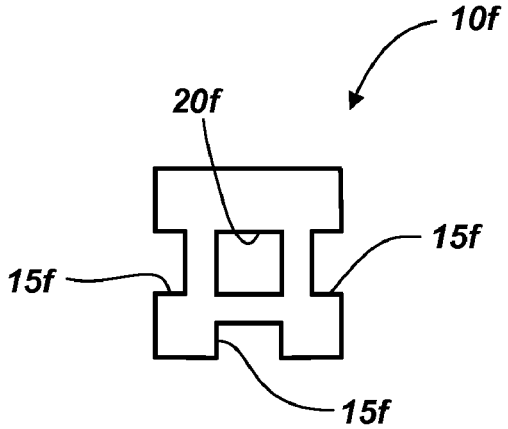
FIG. 7A is a top view of a further alternative embodiment structure in accordance with the principles of the present disclosure.

It will also be understood that a further alternative embodiment structure 10*d* may be provided without a panel portion and having a plurality of slots 15*d*, as shown in FIG. 7. Accordingly, panel portions may be provided separately from the structure 10*d*, and the panel portions may be joined to the structure 10*d* through the slots 15*d*. It will be understood that the quantity, configuration and position of the slots 15*d* may vary as desired in accordance with the principles of the present disclosure. For example, it will be understood that the slots 15*f* may be formed on adjacent sides of the structure 10*f*, as depicted in FIG. 7A, such that the structure 10*f* may form a corner of a barrier with panel portions extending perpendicular to each other.

Figure 8:
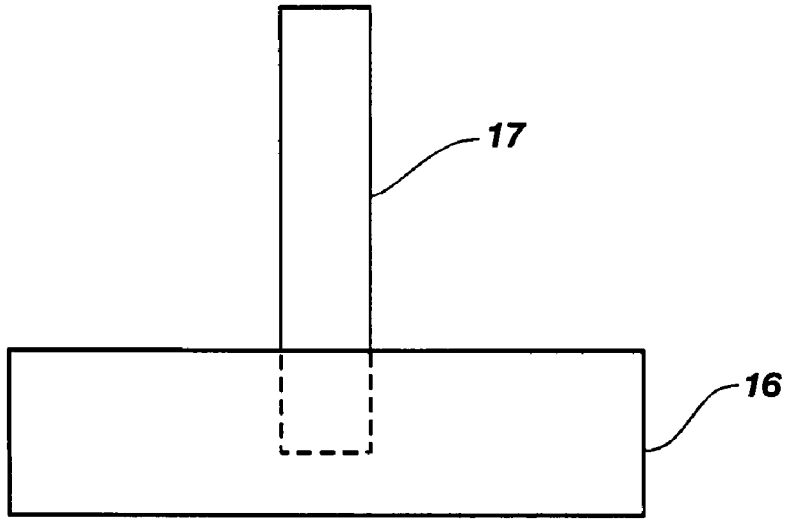
FIG. 8 is a side view of one embodiment of a member embedded in a footing.

Referring now to FIG. 8, a side view is shown of one embodiment of a footing 16 and a rigid member 17. It will be understood that the rigid member 17 may be formed as an "I" shaped member in cross section. Alternatively, it will be understood that the rigid member 17 may be formed of a round pipe member, or a polygonal post member, or any other shaped member known to those skilled in the art. Moreover, the member 17 may have any suitable size within the scope of the present disclosure. The member 17 may be formed of steel or any other suitable material known to those skilled in the art to provide a member 17 that may be substantially rigid. It will be understood that one embodiment of the member 17 may be formed of a material that may be substantially rigid at the time the structure 10 is installed on the footing 16. Accordingly, assembly of the structures 10 may occur rapidly without waiting for concrete within the openings 20 to harden, as would be the case if the member 17 were formed of concrete cast within the opening 20.

The footing 16 may be formed of a concrete material, cast in place or precast in a manner known to those skilled in the art. Moreover, the footing 16 may be sized and include steel reinforcement as is known in the art. As shown in FIG. 8, the rigid member 17 may be attached to the footing 16 by being embedded within the footing 16. It will be understood that the member 17 may be placed in wet concrete forming the footing 16 such that the concrete may bond with the member 17 to form a substantially fixed connection.

It will be understood that the member 17 may be embedded into the footing 16 at various different depths depending on various factors such as the height of the structure 10, the spacing of the column portions 14, and the type of soil supporting the footing 16, for example,. One example of the present disclosure may include a rigid member 17 that may be embedded approximately five feet in the footing 16 and the rigid member 17 may extend another four feet out of the footing 16 for supporting a structure 10 that may be eight feet tall. The footing 16 may be formed approximately two-three feet in diameter for example. Accordingly, it will be understood that the disclosure presented in FIG. 8 is schematic in nature and is not intended to be depicted to scale. Moreover, it will be understood that the features of the present disclosure may vary, including the dimensions of the rigid member 17, the structure 10, and the footing 16, as well as the depth the rigid member 17 may be embedded into the footing 16.

Alternatively, it will be understood that the footing 16 may be formed with an opening into which the member 17 may be received when the footing is in a hardened condition. The member 17 may thereafter be fixed within the footing 26 in any manner known to those skilled in the art, or the member 17 may be retained in the footing due to gravity and/or friction.

Figure 9:
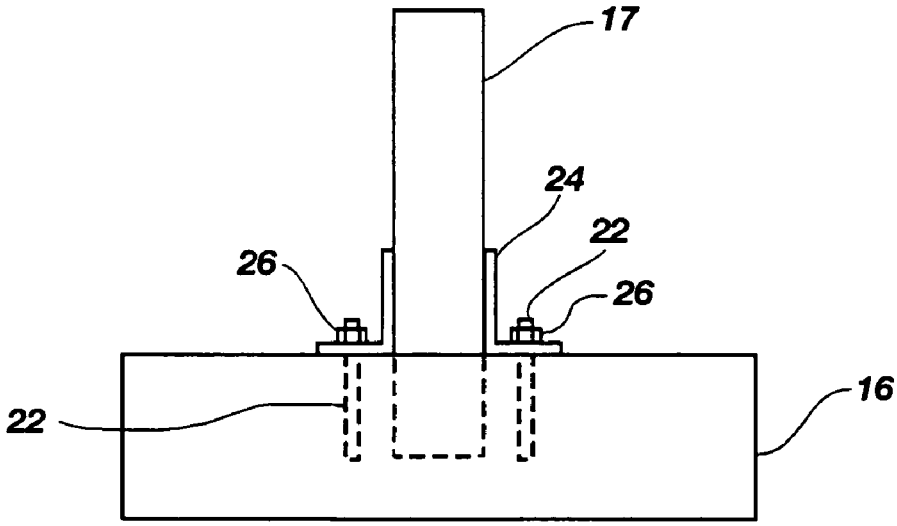
FIG. 9 is a side view of one embodiment of a member attached to a footing.

Referring to FIG. 9, a side view is shown of an alternative embodiment for attaching the member 17 to the footing 16. A plurality of fasteners 22 may be embedded in the footing 16 for attaching to a brace member 24 on the rigid member 17. The fasteners 22 may include bolts or steel rods having a threaded end for receiving a nut 26. It will be understood that any number of fasteners 22 may be utilized to create a suitable connection between the footing 16 and the rigid member 17. The brace 24 may be formed as an angle member or flat member joined to the rigid member 17 in any suitable manner known in the art. For example, the brace member 24 may be welded or bolted to the rigid member 17 such that the brace member 24 may be fixedly attached to the rigid member 17. The brace member 24 may have openings for receiving the fasteners 22 therethrough. Once the fasteners 22 are received through the brace member 24, the nuts 26 may be cinched tight to fixedly attach the rigid member 17 to the footing 16.

Figure 10:
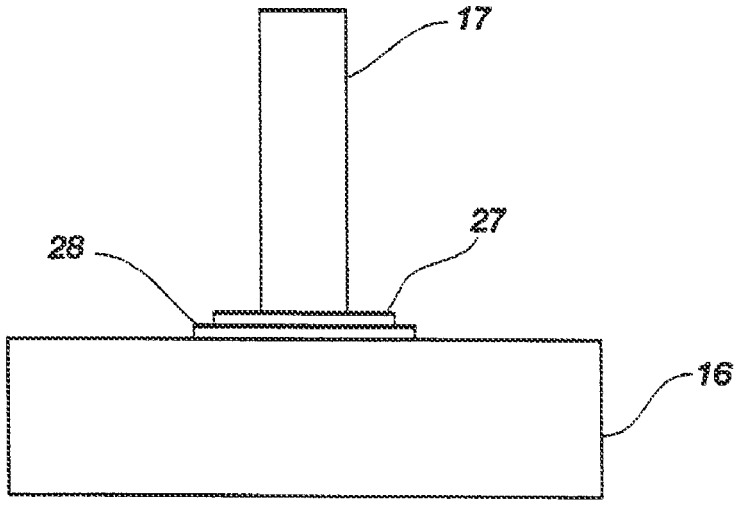
FIG. 10 is a side view of an alternative embodiment of a member attached to a footing.

Referring to FIG. 10, a side view is shown of an another, alternative embodiment for attaching the member 17 to the footing 16. A first plate 27 may be joined to the member 17, such as by welding. A second plate 28 may be joined with the footing 16, such as by being embedded into the footing 16. It will be understood that the second plate 28 may be embedded into the footing 16 so as to protrude above an upper surface of the footing 16, or alternatively, the second plate 28 may be even with the upper surface of the footing 16, or the second plate may be positioned below the upper surface of the footing 16. The first plate 27 may be welded to the second plate 28 to thereby join the member 17 with the footing 16.

Figure 11:
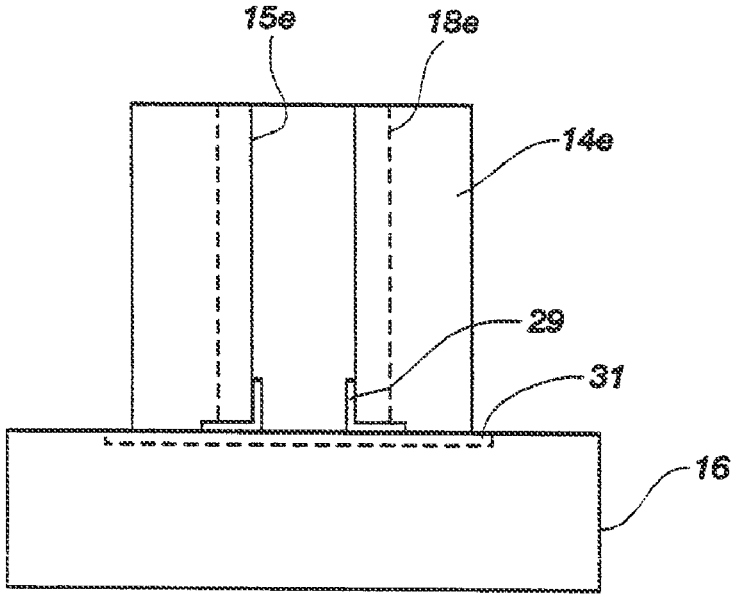
FIG. 11 is a side view of one embodiment of a structure attached to a footing.

Referring now to FIG. 11, a side view is shown of a further embodiment of a connection between a column portion 14*e* and a footing 16. The column portion 14*e* may include a slot 15*e* for receiving a panel portion of an adjacent structure 10 similar to the embodiments previously discussed. The column portion 14*e* may also include reinforcing steel 18*e*, shown in dashed lines, such as rebar. An angle member 29 may be joined to the column portion 14*e* to assist in supporting the column portion in an upright position. The angle member 29 may be welded to the reinforcing steel 18*e*, and/or the angle member 29 may be embedded into the column portion 14*e*, or the angle member 29 may be joined with the column portion 14*e* in any other manner known to those skilled in the art. The angle member 29 may extend around a bottom corner of the slot 15*e* so as to provide a surface for joining with a plate 31 joined with the footing 16. The plate 31 may be embedded in the footing 16, or joined with the footing 16 in any other manner known to those skilled in the art. It will be understood that the angle member 29 may be welded to the plate 31 to support the column portion 14*e* in an upright orientation.

Figure 12:
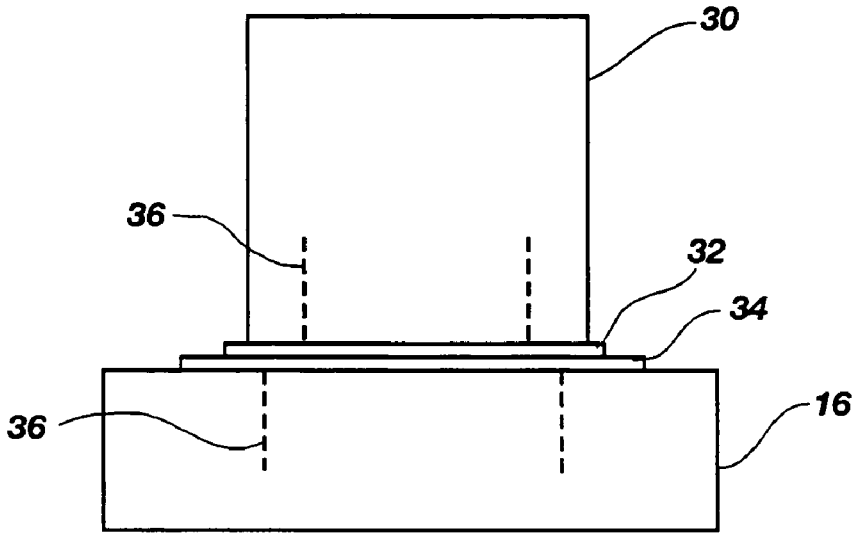
FIG. 12 is a side view of an alternative embodiment structure attached to a footing.

Referring now to FIG. 12, a side view is shown of a further embodiment of a connection between a column 30 and a footing 16. It will be understood that the column 30 may form part or all of the structure 10, or the column 30 may be representative of a rigid member for supporting a structure 10 in an upright position. A first plate 32 may be joined to the column 30 and a second plate 34 may be joined to the footing 16. The first plate 32 may then be joined to the second plate 34 by welding, bolting or any other suitable attachment mechanism known to those skilled in the art. It will be understood that the first plate 32 may be joined with the column 30 using anchors 36 embedded into the column 30, or the first plate 32 may itself be embedded into the column 30, or the first plate 32 may be joined with the column 30 in any other suitable manner known to those skilled in the art. Similarly, the second plate 34 may be joined with the footing 16 using anchors 36, or the second plate 34 may be joined with the footing 16 using any other attaching method known to those skilled in the art.

Figure 13:
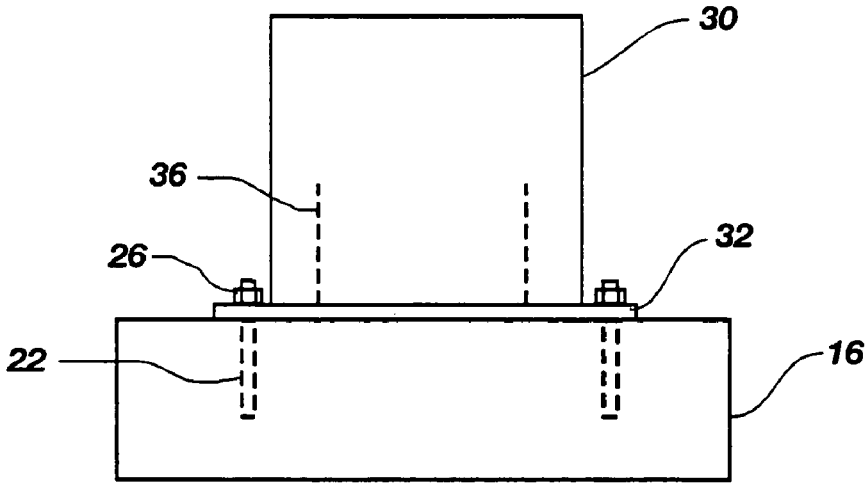
FIG. 13 is a side view of an additional alternative embodiment structure attached to a footing.

Referring to FIG. 13, an additional alternative embodiment connection mechanism is disclosed in which the first plate 32 may be attached to the footing 16 using fasteners 22. The fasteners 22 may be embedded into the footing 16 similar to the embodiment of FIG. 9 discussed previously. The first plate 32 may include openings for receiving the fasteners 22 and nuts 26 may be threaded onto the fasteners to attach the column 30 to the footing 16.

One embodiment of construction of a concrete system in accordance with the principles of the present disclosure will now be described. The structure 10 may be constructed on site or precast in a factory setting under controlled conditions. The structure 10 may be formed to include a desired surface treatment such as a brick or stone wall, for example. The footing or support 16 may typically be formed in place at the construction site. The member 17 may be attached to or embedded in the footing 16 in a desired orientation to ensure that the structure may be oriented as desired. The structure 10 may then be lifted such that the member 17 may be received in the opening 20. This may typically take place as the structure 10 is unloaded from a vehicle transporting the structure 10. A crane or other lifting device may be used to lift the structure 10 and lower the structure 10 over the member 17 onto the footing 16. Welding, bolting, and/or placement of concrete in the opening 20 may be used, for example, to fix the structure 10 to the footing 16. An adjacent structure 10 may be installed in a similar fashion, with the panel portion 12 received in the slot 15. Accordingly, a concrete column, panel and support system may be easily constructed to provide an aesthetically pleasing barrier.

It will also be understood that an alternative embodiment of the present disclosure may include two or more of the structures 10 stacked on top of each other. A rigid member 17 may extend beyond an entire height of the bottom structure 10 up through a portion or all of the height of an upper structure 10. For example, one embodiment of the present disclosure may include a rigid member 17 extending from the footing 16 up to half way through the height of an, upper structure 10. Accordingly, the upwardly stacked structures 10 may be supported in various heights and configurations.

It will be appreciated that the structure and apparatus disclosed herein is merely one example of a means for attaching a concrete structure to a support, and it should be appreciated that any structure, apparatus, or system for attaching a concrete structure to a support that performs, functions the same as, or equivalent to, those disclosed herein are intended to fall within the scope of a means for attaching a concrete structure to a support, including those structures, apparatuses, or systems for attaching that are presently known, or that may become available in the future. Anything that functions the same as, or equivalently to, a means for attaching a concrete structure to a support falls within the scope of this element.

In accordance with the features and combinations described above, a useful method of attaching a structure to a support includes the steps of:

(a) attaching a substantially rigid member to a support;

(b) providing an opening in said structure for receiving said substantially rigid member; and (c) placing said substantially rigid member in said opening.

Those having ordinary skill in the relevant art will appreciate the advantages provided by the features of the present disclosure. For example, it is a feature of the present disclosure to provide a structural system that is simple in design and manufacture. Another feature of the present disclosure is to provide such a structural system that is easy to install. It is a further feature of the present disclosure, in accordance with one aspect thereof, to provide a structural system that is stable and that has an aesthetically pleasing appearance. It is an additional feature of the present disclosure, in accordance with one aspect thereof, to provide a structural system that may include a column portion integral with a panel portion of the structure. Another feature of one aspect of the present disclosure is to provide a structure that may be supported in an upright orientation by a substantially rigid member.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A system comprising:

a first concrete structure and a second concrete structure, each comprising a column portion and a panel portion integrally joined with said column portion, said column portion comprising a side face with an elongated slot formed therein, said panel portion having opposing side faces that extend from said column portion to a terminal distal end face, said slot having a width at said side face that is greater than or equal to the width of said panel portion where said panel portion is joined to said column portion;

a support having said first concrete structure received thereupon; and a substantially rigid member rigidly embedded within said support and received in said slot in said column portion of said first concrete structure for providing lateral support to said first concrete structure, a portion of said panel portion of said second concrete structure being received within said slot in said column portion of said first concrete structure such that said terminal distal end face of said panel portion of said second concrete structure is disposed adjacent to said substantially rigid member within said slot in said first concrete structure.

2. The system of claim 1, wherein said substantially rigid member is an I beam.

3. The system of claim 1, wherein said opposing side faces of said panel portion of each concrete structure are substantially parallel to each other along the entire length thereof between said column portion and said terminal distal end face.

4. The system of claim 1, wherein said panel portion of each concrete structure has a width extending between said opposing side faces that is substantially constant along the entire length between said column portion and said terminal distal end face, said width of said panel portion being sized to fit within said slot on said column portion.

5. The system of claim 4, wherein said terminal distal end face of each concrete structure is substantially planar and extends between said opposing side faces.

6. The system of claim 1, wherein for each concrete structure, said terminal distal end face of said panel portion faces away from said column portion.

7. A system comprising:

a first concrete structure comprising:

a first column comprising a side face with an elongated slot formed therein, said slot being bounded by two opposing side surfaces extending inward from a mouth at said side face of said first column to an end surface that faces toward said mouth of said slot; and a first panel having opposing side faces that extend from said first column to a first terminal distal end face that faces away from said first column;

a support having said first concrete structure received thereupon; and a substantially rigid member attached to said support and received in said slot in said first column for providing lateral support to said first concrete structure, wherein said slot has a width extending between said side surfaces that is substantially constant from said mouth to said rigid member; and a second concrete structure comprising:

a second column comprising a side face with an elongated slot formed therein; and a second panel having opposing side faces that extend from said second column to a second terminal distal end face that faces away from said second column, a portion of said second panel being received within said slot in said first column of said first concrete structure such that said second terminal distal end face is disposed adjacent to said substantially rigid member within said slot of said first concrete structure.

8. The system of claim 7, further comprising a brace for attaching said substantially rigid member to said support.

9. The system of claim 8, further comprising fasteners embedded in said support for attaching to said brace.

10. The system of claim 7, further comprising a first plate attached to said first concrete structure and a second plate attached to said support, wherein said first plate is attachable to said second plate.

11. The system of claim 7, further comprising at least one plate attachable to one of said support and said first concrete structure for attaching said first concrete structure to said support.

12. The system of claim 7, wherein a portion of said substantially rigid member is rigidly embedded within said support.

13. The system of claim 7, wherein said first panel has a width extending between said opposing side faces at said first terminal distal end face and the width of said slot of said first column is greater than or equal to the width of said first panel at said first terminal distal end face.

14. A system comprising:

a first concrete structure having a height extending from a base end to an opposing upper end, said first concrete structure comprising:

a first column portion having a side face that extends along said height of said first column portion, an elongated slot being formed in said side face and extending along said height of said first column portion, said slot being bounded by two opposing side surfaces extending inward from a mouth at said side face of said first column portion to an end surface that faces toward said mouth of said slot; and a first panel portion having opposing side faces that extend from said first column portion to a first terminal distal end face, said first panel portion at said first terminal distal end face being sized to fit within said slot on said first column portion;

a support having said base end of said first concrete structure received thereupon;

a substantially rigid member embedded in or attached to said support and received in said slot in said first column portion toward said end surface for providing lateral support to said first concrete structure, wherein said slot has a width extending between said side surfaces that is substantially constant from said mouth to said rigid member; and a second concrete structure comprising:

a second column portion comprising a side face with an elongated slot formed therein; and a second panel portion having opposing side faces that extend from said second column portion to a second terminal distal end face that faces away from said second column portion, a portion of said second panel portion being received within said slot of said first column portion such that said second terminal distal end face is disposed adjacent to said substantially rigid member within said slot of said first column portion.

15. The system of claim 14, wherein said first column portion and said first panel portion are integral such that said first concrete structure is a one piece member, said second concrete structure being separate and discrete from said first concrete structure.

16. The system of claim 14, wherein said substantially rigid member comprises an I beam.

17. The system of claim 14, further comprising a brace for attaching said substantially rigid member to said support.

18. The system of claim 17, further comprising fasteners embedded in said support for attaching to said brace.

19. The system of claim 14, wherein said first column portion comprises an increased lateral dimension as compared to said first panel portion.

20. The system of claim 14, wherein a portion of said substantially rigid member is rigidly embedded within said support.

21. The system of claim 14, wherein said opposing side faces of said first panel portion are substantially parallel to each other along the entire length thereof between said first column portion and said first terminal distal end face.

22. The system of claim 14, wherein said first panel portion has a width extending between said opposing side faces that is substantially constant along the entire length between said first column portion and said first terminal distal end face.

23. The system of claim 14, wherein said width of said slot of said first column portion is substantially constant from said mouth to said end face.

24. The system of claim 14, wherein said rigid member is securely fixed to said support and said second concrete structure is movable relative to said rigid member.

* * * * *

UNITED STATES PATENT AND TRADEMARK OFFICE

CERTIFICATE OF CORRECTION

PATENT NO. : 7,802,409 B2
APPLICATION NO. : 11/231440
DATED : September 28, 2010
INVENTOR(S) : Stott It is certified that error appears in the above-identified patent and that said Letters Patent is hereby corrected as shown below:

In the Drawings:
Sheet 4, replace Figure 6 with the figure depicted below, wherein the reference number "15c" has been changed to --14c--

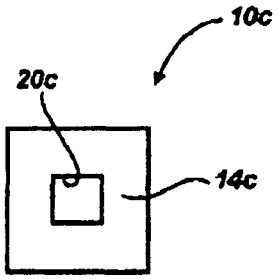

FIG. 6

In the Specifications:

Column 5
Line 51, change "example,." to --example.--
Line 67, change "footing 26" to --footing 16--

Column 6
Line 21, remove [an]
Line 21, change "another," to --another--

Column 7
Line 40, change "an," to --an--

Signed and Sealed this
Fifteenth Day of February, 2011

David J. Kappos
*Director of the United States Patent and Trademark Office*